US005383808A

United States Patent [19]

DuBois

[11] Patent Number: 5,383,808

[45] Date of Patent: Jan. 24, 1995

[54] CONVERTIBLE TOY TRUCK/WAGON

[75] Inventor: David M. DuBois, Providence, R.I.

[73] Assignee: Playskool, Inc., Pawtucket, R.I.

[21] Appl. No.: 195,911

[22] Filed: Feb. 9, 1994

[51] Int. Cl.[6] ..... A63H 17/06; A63H 33/02; A63H 17/00

[52] U.S. Cl. ..... 446/428; 446/451; 446/96; 446/78; 296/180

[58] Field of Search ..... 446/428, 427, 424, 451, 446/450, 71, 72, 73, 75, 77, 78, 93, 94, 95, 96; D21/79, 78, 76; 296/177, 180; 280/7.1, 827

[56] References Cited

U.S. PATENT DOCUMENTS

| | | | |
|---|---|---|---|
| D. 153,765 | 5/1949 | Chroninger . | |
| D. 208,095 | 7/1967 | Ostrander, Jr. . | |
| D. 223,034 | 2/1972 | Sharer . | |
| D. 239,553 | 4/1976 | Brenemen . | |
| D. 258,972 | 4/1981 | Samuels . | |
| D. 271,315 | 11/1983 | Nottingham et al. . | |
| D. 275,691 | 9/1984 | Appel et al. | D21/76 |
| D. 308,552 | 6/1990 | Klawitter . | |
| D. 308,556 | 6/1990 | Klawitter . | |
| 1,572,141 | 2/1926 | Hildebrandt et al. | 446/78 |
| 1,586,624 | 6/1926 | Herrick | 280/7.1 |
| 1,609,536 | 12/1926 | Carlson | 280/827 X |
| 1,712,331 | 5/1929 | Christensen | 446/451 |
| 2,006,420 | 7/1935 | Thompson | D21/78 X |
| 2,186,188 | 1/1940 | Allen | 446/96 |
| 2,495,128 | 1/1950 | Panik | D21/78 X |
| 2,732,659 | 1/1956 | Howard | 446/428 |
| 2,736,990 | 3/1956 | Howard | 446/428 |
| 4,449,322 | 5/1984 | Blumenthal | 446/71 |

FOREIGN PATENT DOCUMENTS

| | | | |
|---|---|---|---|
| 227435 | 4/1959 | Australia | 446/428 |

*Primary Examiner*—Robert A. Hafer
*Assistant Examiner*—D. Neal Muir
*Attorney, Agent, or Firm*—Kurt R. Benson

[57] ABSTRACT

A convertible toy truck/wagon includes a chassis and wheel assembly, a truck bed and a handle member pivotally mounted on the chassis and wheel assembly. The chassis and wheel assembly includes a main chassis member, a truck cab on the chassis member and a plurality of wheels for movably supporting the chassis and wheel assembly on a supporting surface. The truck bed is pivotable on the chassis member between a first substantially horizontal position and a second upwardly pivoted position, and the handle member is pivotable between an inoperative first position in which it extends rearwardly from the cab along the chassis member and an operative second position in which it extends forwardly and upwardly from the truck cab. Accordingly, when the truck bed is in the first position thereof and the handle member is also in the first position thereof, the handle is concealed beneath the truck bed, and when the truck bed is in the first position thereof, and the handle member is in the second position thereof, the handle member can be used for pulling the combination toy truck/wagon in a manner similar to a conventional wagon.

13 Claims, 2 Drawing Sheets

CONVERTIBLE TOY TRUCK/WAGON

BACKGROUND AND SUMMARY OF THE INVENTION

The instant inventions relates to toys and more particularly to a toy truck which is a convertible for use as a toy wagon.

Toy trucks as well as toy wagons have, for many years, been found to have generally high levels of appeal among young children. In this regard, it has generally been found that toy trucks, particularly relatively large toy trucks, can be effectively incorporated into a variety of realistic play themes, and that as a result, they have significant levels of play value. On the other hand, toy wagons have generally been found to be relatively popular as a result of the fact that they can be effectively utilized for transporting various articles including toys of various types. However, while some attempts have been made at combining the advantages and benefits of toy wagons and toy trucks into a single product, the previous attempts have generally been unsuccessful at providing a product which is operable as both an effective toy truck and an effective toy wagon.

In any event, devices representing the closest prior art to the subject invention of which the applicant is aware are disclosed in the U.S. Patents to Chroninger, Des. U.S. Pat. No. 153,765; Ostrander, Jr., Des. U.S. Pat. No. 208,095; Sharer, Des. U.S. Pat. No. 223,034; Breneman et al, Des. U.S. Pat. No. 239,553; Samuels, Des. U.S. Pat. No. 258,972; Nottingham et al, Des. U.S. Pat. No. 271,315; Klawitter, Des. U.S. Pat. No. 308,552 and Klawider, Des. U.S. Pat. No. 308,556. Of these references, the U.S. Patents to Klawitter are believed to be the most relevant prior art. However, even the devices disclosed in these references are believed to be of only general interest with respect to the convertible toy truck/wagon of the instant invention.

The instant invention provides an effective convertible toy truck/wagon comprising a truck chassis and wheel assembly which includes a main chassis member, a cab on the chassis member and a plurality of wheels for supporting the chassis and wheel assembly on a supporting surface. The convertible toy truck/wagon further comprises a truck bed and means pivotally mounting the truck bed on the chassis member behind the cab so that the truck bed is pivotable between a first position in which the truck bed is received in a substantially horizontal disposition on the chassis member and a second position in which the truck bed is pivoted upwardly relative to the chassis member. The convertible toy truck/wagon further comprises a handle which is pivotally attached to the chassis and wheel assembly such that when the truck bed is in the upwardly pivoted second position thereof, the handle member is pivotable between a first position in which it extends rearwardly along the chassis member behind the cab and a second position in which the handle member extends forwardly beyond the cab. The toy truck/wagon is further adapted so that the truck bed is receivable in the first position thereof regardless of whether the handle member is in the first position thereof or the second position thereof.

In the preferred embodiment of the convertible toy truck/wagon the truck bed is formed as a dump truck bed, and it is pivotally mounted adjacent the rear end thereof on the chassis member along an axis which is also adjacent the rear end of the chassis member. Further, the handle member is preferably pivotally attached to an upper rear portion of the cab to pivotally attach the handle member to the chassis and wheel assembly. The handle member preferably includes angularly disposed opposite first and second end portions, and the first end portion of the handle member is preferably pivotally attached to the upper rear portion of the cab. The handle member is preferably further formed so that when it is in the first position thereof, the first end portion of the handle member extends angularly rearwardly and downwardly from the upper rear portion of the cab and so that the second end portion of the handle member extends rearwardly in a substantially horizontal disposition along the chassis member. Still further, the chassis member preferable has a recess formed therein, and the second end portion of the handle member is preferably received in the recessed when the handle member is in the first position thereof. Even still further, because of the structural relationship between the truck bed and the chassis, when the handle member is received in the first position thereof so that it is received in the recess and the truck bed is positioned in the first position thereof, the truck bed is received in substantially covering relation over the recess and the second end portion of the handle member. The handle member is, however, attached to the cab so that when the truck bed is in the upwardly pivoted second position thereof, the handle member can be pivoted forwardly so that the first end portion thereof extends angularly, upwardly and forwardly above the cab and so that the second end portion of the handle member extends further forwardly from the first end portion. Still further, the handle member is preferably pivotally attached to the cab so that when the truck bed is in the first position thereof and the handle member is in the forwardly extending second position thereof, the handle member is nevertheless pivotable upwardly to an intermediate third position in which the first end portion of the handle member extends substantially vertically upwardly and the second end portion of the handle member extends angularly upwardly and forwardly.

It has been found that the instant invention provides an effective convertible toy truck/wagon which has significant advantages over the heretofore available combination truck/wagon assemblies. Specifically, it has been found that because of the manner in which the handle is pivotable between the first and second positions thereof when the bed portion of the truck is in an upwardly pivoted position, the convertible toy truck/wagon can be effectively and easily converted from a toy truck configuration in which the handle member is concealed beneath the bed of the truck and a wagon configuration in which the handle member extends forwardly from the upper rear portion of the cab of the truck. It has been further found that when the handle member is in the forwardly extending second position, it can be effectively utilized for pulling the convertible toy truck/wagon in a manner similar to a conventional wagon. Accordingly, the convertible truck/wagon of the instant invention effectively combines the advantages of a toy truck with those of a toy wagon to provide a single product which has a significantly increased level of appeal.

Accordingly, it is primary object of the instant invention to provide an effective convertible toy truck/wagon which is readily and easily convertible from a toy truck configuration to a toy wagon configuration.

Another object of the instant invention is to provide an effective convertible toy truck/wagon which is convertible from a toy truck configuration to a toy wagon configuration, and which includes a handle which is concealed when the device is in a toy truck configuration.

An even still further object of the instant invention is to provide a convertible toy truck/wagon comprising a pivotally mounted dump truck bed and a handle which is concealed beneath the dump truck bed when the device is in a truck configuration.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
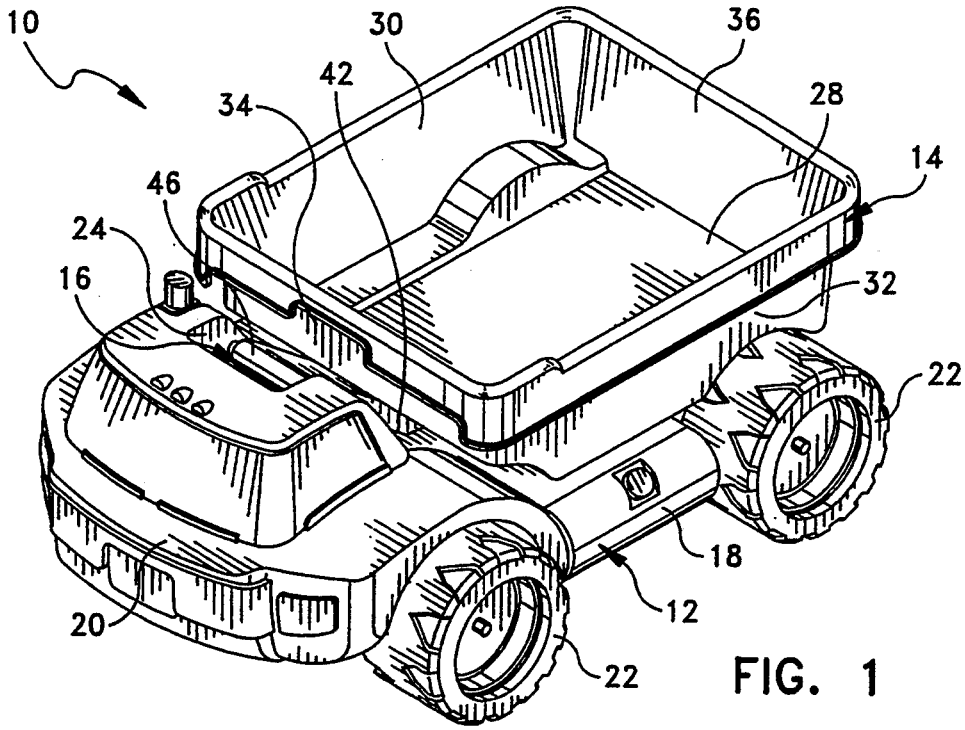
FIG. 1 is a perspective view of the convertible toy truck/wagon of the instant invention in a toy truck configuration.

Referring now to the drawings, the combination toy truck/wagon of the instant invention is illustrated in FIGS. 1 through 4 and generally indicated at 10. The truck/wagon 10 includes a chassis and wheel assembly generally indicated at 12, a truck bed generally indicated at 14 and a handle generally indicated at 16. As illustrated, the combination truck/wagon 10 is alternatively positionable in the first position thereof illustrated in FIG. 1 in which the handle 16 is concealed and the combination toy truck/wagon 10 is configured as a toy truck and the second position thereof illustrated in FIG. 4 in which the handle 16 extends forwardly from the chassis and wheel assembly 12 and the truck bed 14. Accordingly, when the combination toy truck/wagon 10 is in the second position thereof, the handle 16 can be conveniently used by a small child for pulling the combination toy truck/wagon 10 along a supporting surface in a manner similar to a conventional wagon.

The chassis and wheel assembly 12 includes a main chassis element 18 having a cab 20 thereon, and a plurality of wheels 22. The main chassis element 18 and the cab 20 are preferably integrally molded from a suitable rigid plastic material, and the main chassis element 18 is configured so that it extends rearwardly from the cab 20 so that it provides a supporting frame structure for the truck bed 14. As illustrated, the cab 20 has a handle mounting recess 24 formed in the upper rear extremity thereof, and the main chassis element 18 has a handle storage recess 26 formed therein. The storage recess 26 extends generally horizontally rearwardly along the upper side of the main chassis element 18 behind the cab 20 as illustrated most clearly in FIG. 3. The chassis and wheel assembly 12 includes four of the wheels 22 which are rotatably mounted on the main chassis element 18 in a conventional manner. Accordingly, the wheels 22 are operative for movably supporting the chassis and wheel assembly 12 on a supporting surface in a conventional manner. It will be understood, however, that other embodiments of the chassis and wheel assembly 12 which include other types or quantities of wheels are contemplated.

The truck bed 14 is formed as a conventional dump truck bed, and it includes a bottom wall 28, a pair of spaced side walls 30 and 32, and front and rear walls 34 and 36, respectively. The truck bed 14 further includes a pair of pivot shaft mounting members 38 and a pivot shaft 40 which are integrally formed as a combined unit on the underside of the bottom wall 28 as illustrated in FIG. 3. The pivot shaft 40 extends outwardly in opposite directions beyond the mounting members 38, and the outwardly extending ends (not shown) of the shaft 40 are rotatably received in integrally formed sockets (not shown) at the rear end of the main chassis element 18. Accordingly, the truck bed 14 is pivotable between the first position illustrated in FIGS. 1 and 4 in which the truck bed 14 is in a substantially horizontal disposition on the main chassis element 18 and the second position illustrated in FIGS. 2 and 3 in which the forward end of the truck bed 14 is pivoted upwardly about the axis defined by the pivot shaft 40 so that the truck bed 14 is in a nearly vertical disposition.

Figure 2:
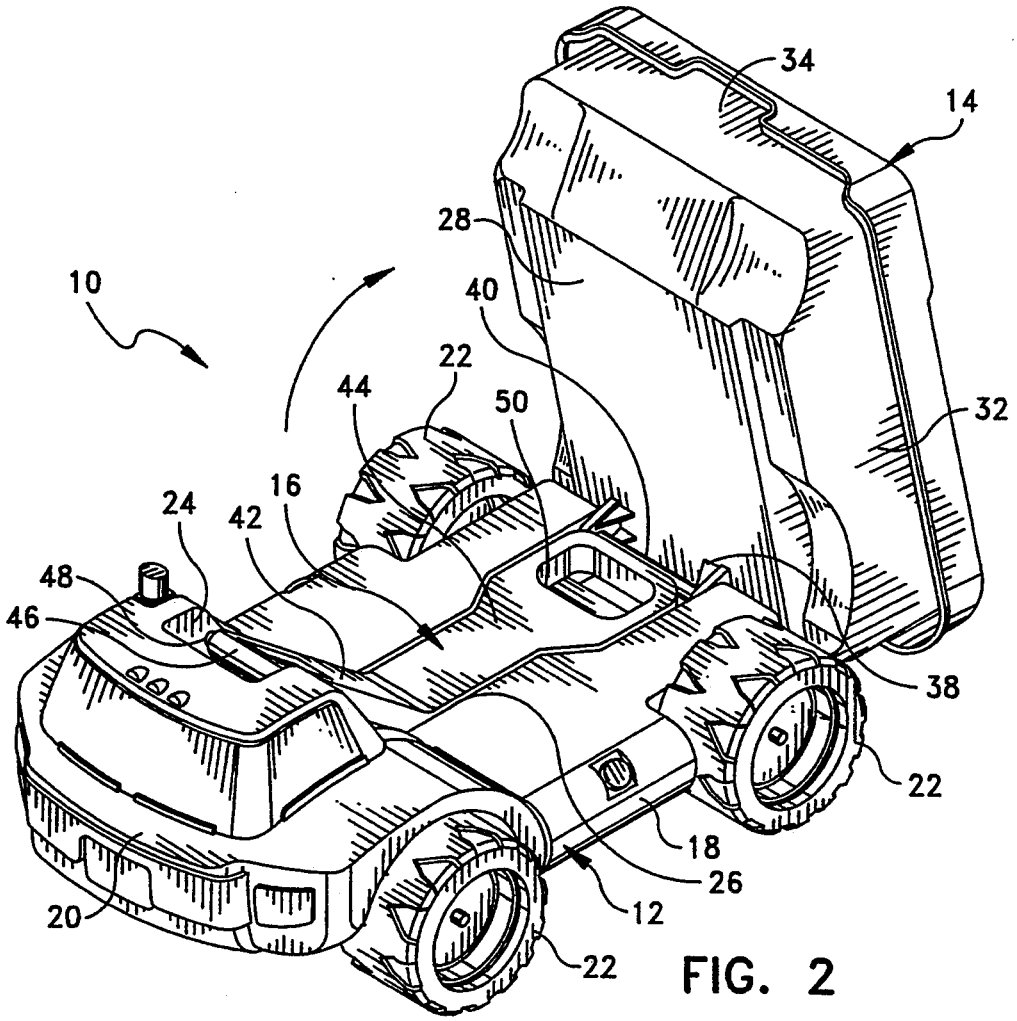
FIG. 2 is a perspective view thereof with the bed portion of the truck pivoted rearwardly.
Figure 3:
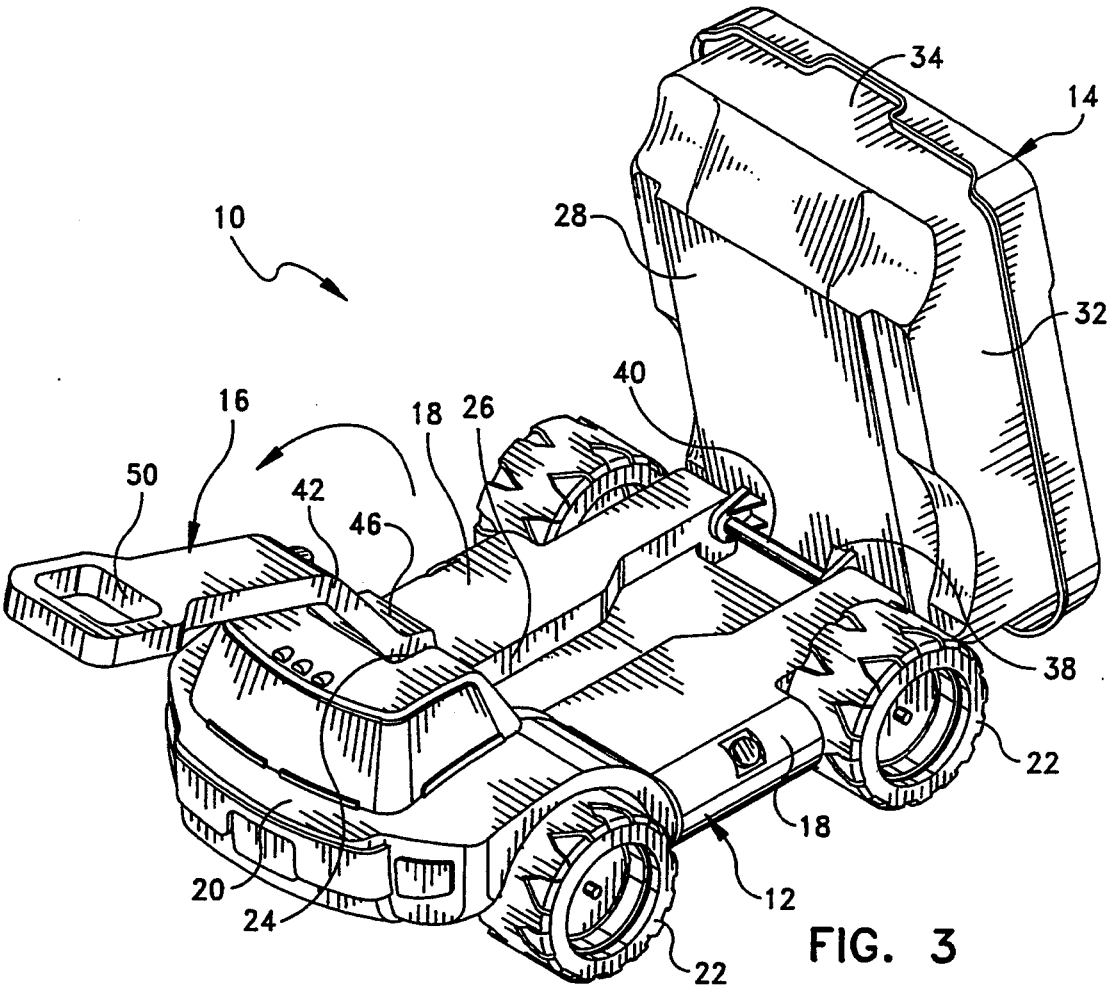
FIG. 3 is a similar perspective view with the handle portion pivoted forwardly.
Figure 4:
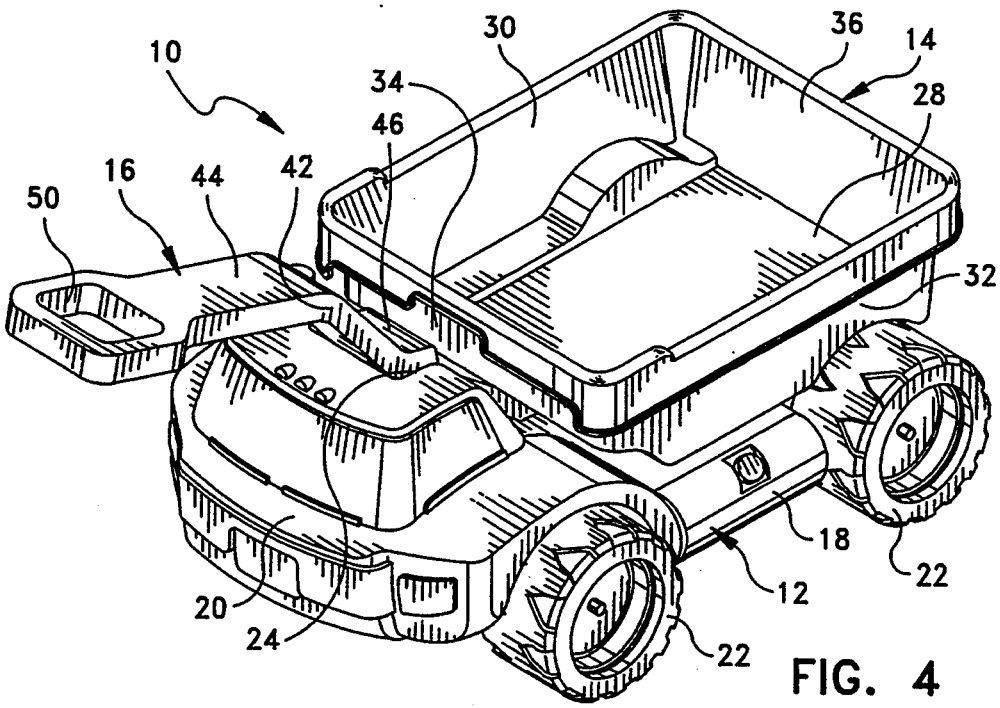
FIG. 4 is a perspective view of the convertible toy truck/wagon in a toy wagon configuration.

The handle 16 is adapted so that it is alternatively pivotable between the first or stored position thereof illustrated in FIG. 2 and the second or operative position thereof illustrated in FIGS. 3 and 4. The handle 16 includes angularly disposed opposite first and second end portions 42 and 44, respectively. The first end portion 42 terminates in a mounting portion 46 having a pair of outwardly extending mounting shafts 48 thereon as best seen in FIG. 2. The mounting shafts 48 are received in corresponding sockets formed in the mounting recess 24 for pivotally mounting the handle 16 on the upper rear portion of the cab 20 as illustrated in FIG. 2. When the handle 16 is in the first or stored position thereof, the first end portion 42 extends angularly downwardly and rearwardly from the mounting recess 24, and the second end portion 44 is received in the recess 26 so that the second end portion 44 extends substantially horizontally rearwardly along the main chassis element 18 behind the cab 20. As further illustrated in FIG. 2 the recess 26 and the second end portion 44 of the handle 16 are correspondingly formed so that the second end portion 44 is substantially entirely received in the recessed 26 when the handle 16 is in the first position thereof. As a result, when the handle 16 is in the first position thereof, the truck bed 14 can be pivoted downwardly to the first position thereof illustrated in FIG. 1 wherein the truck bed 14 is received in covering relation over the recess 26, and the recess 26 and the second end portion 44 of the handle 16 are concealed beneath the truck bed 14. Alternatively, however, when the truck bed 14 is pivoted upwardly to the second position thereof illustrated in FIGS. 2 and 3, the handle 16 can be pivoted upwardly and forwardly to the second position of the handle 16 illustrated in FIGS. 3 and 4. As illustrated, when the handle 16 is in the second position thereof, the first end portion 42 of the handle 16 extends angularly upwardly and forwardly from the upper rear portion of the cab 20, and the second end portion 44 extends further forwardly from the first end portion 42. As further illustrated, the second end portion 44 is configured so as to include a handle opening 50. Accordingly, by pivoting the bed 14 to the downward first position thereof when the handle 16 is in the forwardly extending first position thereof, the handle 16 can be effectively utilized for pulling the truck/wagon 10 along a supporting surface in a manner similar to a conventional wagon. Further, because of the overall configuration of the handle 16 and the manner in which it is mounted on the upper rear portion of the cab 20, the handle 16 can be pivoted upwardly slightly to a third or intermediate position when the bed 14 is in the first position thereof so that the handle 16 can be more effectively and conveniently utilized for pulling the truck/wagon 10 along a supporting surface.

It is seen therefore that the instant invention provides an effective convertible toy truck/wagon. The truck/wagon 10 can be conveniently converted between the position illustrated in FIG. 10 wherein the truck/wagon 10 is configured to resemble a conventional dump truck and the position illustrated in FIG. 4 wherein the handle 16 can be utilized for pulling the truck/wagon 10 along a supporting surface in a manner similar to a conventional wagon. Further, the truck/wagon 10 is adapted so that when it is in the first position thereof illustrated in FIG. 1, the main portions of the handle 16 are concealed beneath the truck bed 14. Further, the truck/wagon 10 is adapted so that it can be effectively converted from the first position thereof illustrated in FIG. 1 to the second position thereof illustrated in FIG. 4 by tilting the truck bed 14 upwardly and rearwardly in a manner similar to a conventional dump truck. Hence, the truck/wagon 10 effectively combines the advantages of a toy truck and a toy wagon into a single product, and because of the way this combination is carried out, the truck/wagon 10 can be effectively utilized as either a conventional toy dump truck or as a conventional toy wagon. Hence, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible toy truck/wagon comprising:

a) a truck chassis and wheel assembly having front and rear ends and including a chassis member, a cab on said chassis member and a plurality of wheels on said chassis member for movably supporting said chassis and wheel assembly on a supporting surface;

b) a truck bed having front and rear ends;

c) means pivotally mounting said truck bed on said chassis member behind said cab such that said truck bed is pivotable between a first position wherein said truck bed is received in a substantially horizontal disposition on said chassis member and a second position wherein said truck bed is pivoted upwardly and rearwardly relative to said chassis member;

d) handle means including a handle member having first and second ends, said handle member being pivotally attached to said chassis and wheel assembly such that when said truck bed is in the second position thereof, said handle member is pivotable between a first position wherein said handle member extends rearwardly from the first end thereof along said chassis member behind said cab and a second position wherein said handle member extends forwardly from the first end thereof and the second end thereof is disposed forward of said cab; and e) said handle member being disposed beneath said truck bed when said handle member and said truck bed are in the respective first positions thereof.

2. In the convertible toy truck/wagon of claim 1, said truck bed comprising a dump truck bed.

3. In the convertible toy truck/wagon of claim 1, said truck bed being pivotally mounted along an axis adjacent the rear end thereof on said chassis member.

4. In the convertible toy truck/wagon of claim 3, said axis also being adjacent the rear end of said chassis member.

5. In the convertible toy truck/wagon of claim 1, said truck bed being pivotally mounted on said chassis member along an axis adjacent the rear end of said chassis member.

6. In the convertible toy truck/wagon of claim 1, said handle member being pivotally attached to said cab.

7. In the convertible toy truck/wagon of claim 1, said chassis member having a recess formed therein for receiving said handle member, said handle member being received in said recess when said handle member is in the first position thereof.

8. In the convertible toy truck/wagon of claim 7, said truck bed being received in substantially covering relation over said recess when said truck bed is in the first position thereof.

9. In the convertible toy truck/wagon of claim 1, said handle member being pivotally attached adjacent the first end thereof to an upper rear portion of said cab, said handle member including angularly disposed first and second end portions, said first end portion extending downwardly and rearwardly from said upper rear portion of said cab and said second end portion extending substantially horizontally rearwardly along said chassis member from said first end portion when said handle member is in the first portion thereof.

10. In the convertible toy truck/wagon of claim 9, the first end portion of said handle member extending angularly forwardly and upwardly when said handle member is in the second position thereof, said handle member being pivotable between the second position thereof and an intermediate third position wherein the first end portion of said handle member extends substantially vertically upwardly when said truck bed is in the first position thereof.

11. In the convertible toy truck/wagon of claim 1, said handle member being interposed between said truck bed and said chassis member when said handle member and said truck bed are in the respective first positions thereof.

12. In the convertible toy truck/wagon of claim 1, said handle member being disposed in underlying relation beneath said truck bed when said handle member and said truck bed are in the respective first positions thereof.

13. A convertible toy truck/wagon comprising:

a) a truck chassis and wheel assembly having front and rear ends and including a chassis member, a cab on said chassis member and a plurality of wheels on said chassis member for movably supporting said chassis and wheel assembly on a supporting surface;

b) a truck bed having front and rear ends;

c) means pivotally mounting said truck bed on said chassis member behind said cab such that said truck bed is pivotable between a first position wherein said truck bed is received in a substantially horizontal disposition on said chassis member and a second position wherein said truck bed is pivoted upwardly and rearwardly relative to said chassis member;

d) handle means including a handle member having first and second ends, said handle member being pivotally attached to said chassis and wheel assembly such that when said truck bed is in the second position thereof, said handle member is pivotable between a first position wherein said handle member extends rearwardly from the first end thereof along said chassis member behind said cab and a second position wherein said handle member extends forwardly from the first end thereof and the second end thereof is disposed forward of said cab; and e) said handle member being disposed beneath said truck bed when said handle member and said truck bed are in the respective first positions thereof.

f) said truck bed being positionable in the first position thereof when said handle member is in either of the first and second positions thereof.

* * * * *